US009282408B2

(12) United States Patent
Ong

(10) Patent No.: US 9,282,408 B2
(45) Date of Patent: Mar. 8, 2016

(54) PROCESSING METHOD AND PROCESSING APPARATUS FOR STEREO AUDIO OUTPUT ENHANCEMENT

(75) Inventor: Kok Huan Ong, Singapore (SG)

(73) Assignee: Creative Technology Ltd, Singapore (SG)

( * ) Notice: Subject to any disclaimer, the term of this patent is extended or adjusted under 35 U.S.C. 154(b) by 179 days.

(21) Appl. No.: 14/119,334

(22) PCT Filed: Apr. 26, 2012

(86) PCT No.: PCT/SG2012/000149

§ 371 (c)(1),
(2), (4) Date: Nov. 21, 2013

(87) PCT Pub. No.: WO2012/161653

PCT Pub. Date: Nov. 29, 2012

(65) Prior Publication Data

US 2014/0112479 A1 Apr. 24, 2014

(30) Foreign Application Priority Data

May 25, 2011 (SG) ..... 201103768-6

(51) Int. Cl.

| | |
|---|---|
| ***H04R 5/00*** | (2006.01) |
| ***H04R 5/04*** | (2006.01) |
| ***H04S 5/00*** | (2006.01) |
| ***H04S 7/00*** | (2006.01) |
| *H04S 1/00* | (2006.01) |

(52) U.S. Cl.
CPC .. *H04R 5/04* (2013.01); *H04S 5/00* (2013.01); *H04S 7/30* (2013.01); *H04S 1/00* (2013.01); *H04S 2400/05* (2013.01)

(58) Field of Classification Search
CPC ..... H04S 5/00; H04S 7/30; H04S 1/00; H04S 2400/05; H04R 5/04
USPC ..... 381/17, 1, 18, 58, 77, 307
See application file for complete search history.

(56) References Cited

U.S. PATENT DOCUMENTS 4,192,969 A * 3/1980 Iwahara ..... 381/1

OTHER PUBLICATIONS

International Search Report and the Written Opinion of the International Searching Authority, PCT/SG2012/000149, May 31, 2012.

* cited by examiner

*Primary Examiner* — Paul S Kim
(74) *Attorney, Agent, or Firm* — Russell Swerdon; Desmund Gean

(57) ABSTRACT

A processing method and processing apparatus suitable for stereo audio output enhancement. The processing apparatus can include an input portion configurable to receive a set of input signals, an intermediate portion coupled to the input portion and an output portion coupled to the intermediate portion. The input portion can be configured to produce processed input signals based on the set of input signals. The intermediate portion can be configured to produce a compensated signal based on the processed input signals. The intermediate portion can also be configured to produce a first mixed signal and a second mixed signal based on the set of input signals and at least a portion of the compensated signal. The output portion can be configured to produce a set of output signals based on the first and second mixed signals.

18 Claims, 11 Drawing Sheets

PROCESSING METHOD AND PROCESSING APPARATUS FOR STEREO AUDIO OUTPUT ENHANCEMENT

FIELD OF INVENTION

The present disclosure generally relates to signal processing of audio signals. More particularly, various embodiments of the disclosure relate to a processing apparatus and a processing method suitable for stereo audio output enhancement.

BACKGROUND

Recorded audio signals can generally be based on a mix of a plurality of individual audio sources. The recorded audio signals can, for example, be recorded music played by an orchestra and an individual sound source can be a musical instrument such as a violin within the orchestra.

Recorded audio signals are generally played back and experienced by listeners via an audio system as played back audio signals. The audio system can include a speaker system via which a listener can experience played back audio signals. Listener experience whilst experiencing played back audio signals can be associated with whether or not a listener is capable of experiencing, based on played back audio signals from the speaker system, the mix of the plurality of individual audio sources of audio signals, as recorded.

Thus for the purposes of listener experience, faithful reproduction of audio signals as recorded desirable. More particularly, for the purposes of listener experience, played back audio signals via the speaker system should desirably be a faithful reproduction of the recorded audio signals. However, depending on speaker characteristics, such as speaker dispersion, of the speaker system, the area within which a listener is fully capable of experiencing the aforementioned faithful reproduction can be limited. The above mentioned area is generally referred to as "sweet spot".

Appreciably, it is desirable for the speaker system to have a large "sweet spot" so that the area within which a listener is fully capable of experiencing the aforementioned faithful reproduction need not be unduly limited. Thus a large "sweet spot" would be desirable for the purposes of enhancing listener experience.

Conventional techniques to enlarge the "sweet spot" include providing a speaker system such that a listener is strategically surrounded with individual speakers. An example of such a technique is a 5.1 type surround sound system. Another example is a 7.1 type surround sound system.

Unfortunately conventional techniques fail to facilitate listener experience enhancement in a suitably efficient manner as complex speaker systems may be required for the purposes of suitably surrounding a listener with speakers so as to enlarge the "sweet spot".

Moreover, conventional techniques may be setup dependent as there is need to consider placement of each speaker of the speaker system around a listener. Incorrect or inaccurate placement of speakers may thus potentially detract listener experience. Thus conventional techniques may not be user friendly in terms of implementation.

It is therefore desirable to provide a solution to address at least one of the foregoing problems of conventional techniques.

SUMMARY OF THE INVENTION

In accordance with a first aspect of the disclosure, a processing apparatus is provided. The processing apparatus can be configured for receiving and processing a set of input signals. The set of input signals can include a first input signal and a second input signal.

The processing apparatus can include an input portion, an intermediate portion and an output portion. The intermediate portion can be coupled to the input portion and the output portion can be coupled to the intermediate portion.

The input portion can be configured for receiving and processing the set of input signals in a manner so as to produce processed input signals.

The intermediate portion can be configured for processing the processed input signals in a manner so as to produce a compensated signal. The intermediate portion can be further configured for processing the set of input signals in a manner such that the first input signal is mixed with at least a portion of the compensated signal to produce a first mixed signal and the second input signal is mixed with at least a portion of the compensated signal to produce a second mixed signal. Additionally, the intermediate portion can include a first mixer, a second mixer, a third mixer and a compensator.

The first mixer can be coupled to the input portion in a manner so as to receive the first input signal. Moreover, the first mixer can be configured for producing the first mixed signal. The second mixer can be coupled to the input portion in a manner so as to receive the second input signal. Moreover, the second mixer can be configured for producing the second mixed signal. The third mixer can be coupled to the input portion in a manner so as to receive the processed input signals. Moreover, the third mixer can be configured for processing the first and second processed input signals in a manner such that the first processed input signal is mixed with the second processed input signal so as to produce a third mixed signal.

The compensator can be coupled to at least one of the first mixer, the second mixer and the third mixer. Moreover, the compensator can be configured for receiving and processing the third mixed signal in a manner so as to produce the compensated signal. The compensator can be further configured to communicate at least a portion of the compensated signal to each of the first and second mixers.

The output portion can be configured to process the first and second mixed signals in a manner so as to produce a set of output signals. The set of output signals can include a first output signal and a second output signal.

Additionally, the output portion can be configured to process the first and second mixed signals in a manner so as to produce a first filter processed signal and a second filter processed signal respectively.

Moreover, the output portion can be configured to produce the first and second output signals based on the second filter processed signal and the first filter processed signal respectively.

In accordance with a second aspect of the disclosure a processing method is provided. The processing method can include receiving a set of input signals, processing the received set of input signals in a manner so as to produce processed input signals, producing a set of intermediate signals and processing the set of intermediate signals.

The set of intermediate signals can include at least a portion of a compensated signal, a first mixed signal and a second mixed signal. Additionally, the set of intermediate signals can be processed in a manner so as to produce a set of output signals. The set of output signals can include a first output signal and a second output signal.

The processed input signals can be processed in a manner so as to produce the compensated signal.

The set of input signals can be processed in a manner such that the first input signal is mixed with at least a portion of the compensated signal to produce a first mixed signal. Furthermore the set of input signals can be processed in a manner such that the second input signal is mixed with at least a portion of the compensated signal to produce a second mixed signal.

The first and second mixed signals can be processed in a manner so as to produce a first filter processed signal and a second filter processed signal respectively. The first and second output signals can be based on the second filter processed signal and the first filter processed signal respectively.

BRIEF DESCRIPTION OF THE DRAWINGS

Embodiments of the disclosure are described hereinafter with reference to the following drawings, in which.

DETAILED DESCRIPTION

Representative embodiments of the disclosure, for addressing one or more of the foregoing problems associated with conventional techniques, are described hereinafter with reference to FIG. 1 to FIG. 5.

Figure 1A:
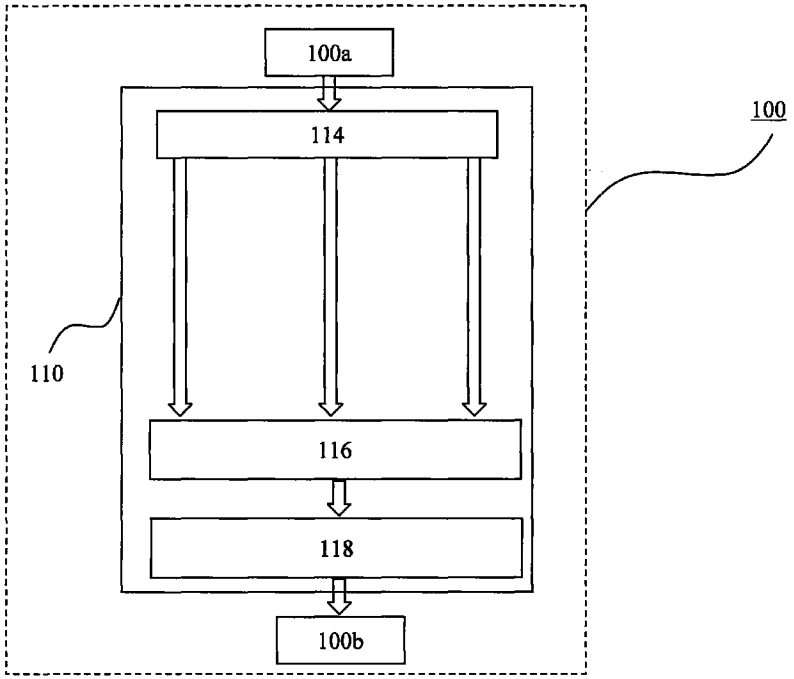
FIG. 1*a* shows a system which includes an input module, an output module and a processing apparatus having an input portion, an intermediate potion and an output portion, according to an embodiment of the disclosure.

A system 100, in accordance with an embodiment of the disclosure, which includes an input module 100*a*, a processing apparatus 110 and an output module 100*b*, is shown in FIG. 1*a*. The input module 100*a* can be coupled to the processing apparatus 110 which can be coupled to the output module 100*b*.

The input module 100*a* can be configured to communicate a set of input signals. The input module 100*a* can, for example, be an audio source which provides a set of input signals. The set of input signals can, for example, include a first input signal and a second input signal. The output module 100*b* can, for example, be a speaker system which includes a speaker array.

The set of input signals can be communicated to the processing apparatus 110. The processing apparatus 110 can be configured to process the set of input signals in a manner, which will be described in further detail later with reference to FIG. 1*b*-FIG. 1*f*, so as to produce a set of output signals. The set of output signals can be communicated from the processing apparatus 110 to the output module 100*b*.

The processing apparatus 110 includes an input portion 114, an intermediate portion 116 and an output portion 118.

The input portion 114 can be configured to receive the set of input signals from the input module 100*a*. The input portion 114 can be coupled to the intermediate portion 116. The intermediate portion 116 can be coupled to the output portion 118.

The input portion 114 can be configured to receive and process the input signals in a manner, as will be further discussed with reference to FIG. 1*b*, so as to produce processed input signals. The processed input signals can be communicated from the input portion 114 to the intermediate portion 116 for further processing. Additionally, the set of input signals can also be communicated from the input portion 114 to the intermediate portion 116 for processing.

The intermediate portion 116 can be configured to receive one or both of the set of input signals and the processed input signals for processing in a manner, which will be discussed in further detail with reference to FIG. 1*b*, so as to produce a set of intermediate signals.

The set of intermediate signals can be communicated from the intermediate portion 116 to the output portion 118 for further processing. Particularly, the output portion 118 can be configured to receive and process the set of intermediate signals in a manner, as will be discussed in further detail with reference to FIG. 1*c* and FIG. 1*d*, so as to produce the above mentioned set of output signals.

The set of output signals can be communicated from the output portion 118 to the output module 110*b*. Based on the set of output signals, the output module 100*b* can be configured to produce a set of reproduction signals, as will be further discussed in greater detail with reference to FIG. 1*e* and FIG. 1*f*.

Figure 1B:
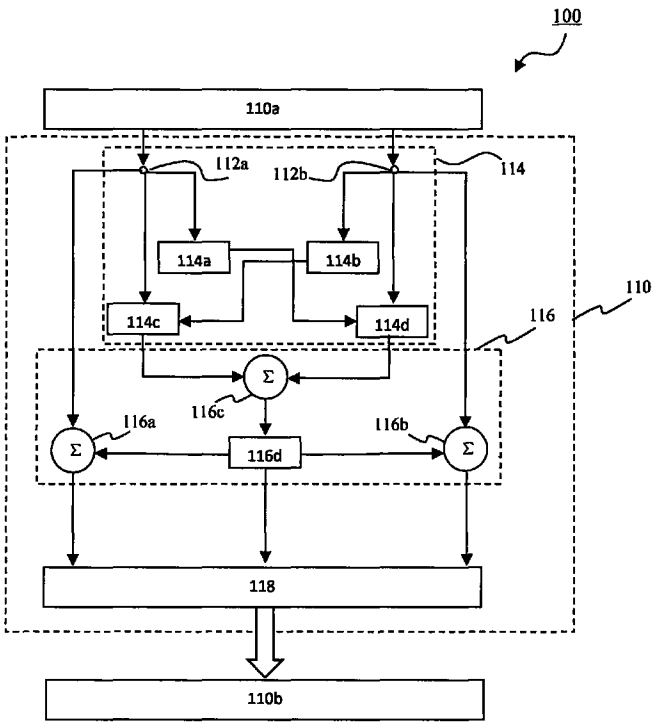
FIG. 1*b* shows the input portion and the intermediate portion of FIG. 1*a* in further detail, according to an embodiment of the disclosure.

FIG. 1*b* shows the system 100 in further detail. Particularly, the processing apparatus 110 is shown in further detail. More particularly, the input portion 114 and the intermediate portion 116 of the processing apparatus 110 are shown in further detail.

The input portion 114 can include a first input port 112*a* and a second input port 112*b*. Additionally, the input portion 114 can include a first detector 114*a*, a second detector 114*b*, a first combiner 114*c* and a second combiner 114*d*.

The first and second input ports 112*a*/112*b* can be coupled to the input module 100*a* in a manner so as to receive the first and second input signals. Specifically, the first and second input signals can be received by the processing apparatus 110 via the first and second input ports 112*a*/112*b* respectively. The first and second input signals can correspond to a left audio signal and a right audio signal respectively. Alternatively, the first and second input signals can correspond to a right audio signal and a left audio signal respectively.

The first input port 112*a* can be further coupled to the first detector 114*a* and the first combiner 114*c*. Specifically, the first detector 114*a* and the first combiner 114*c* can be coupled to the first input port 112*a* in a manner such that the first input signal can be received by the first detector 114*a* and the first combiner 114*c*. The first detector 114*a* can also be coupled to the first combiner 114*c*. The first detector 114*a* can be further coupled to the second combiner 114*d*. The first detector 114*a* can be configured to receive and process the first input signal in a manner so as to produce a first preliminary signal. The first preliminary signal can be communicated from the first detector 114*a* to the second combiner 114*d*. Moreover, as will be discussed later in further detail, the first input port 112*a* can yet be further coupled to the intermediate portion 116 in a manner such that the first input signal can be communicated to the intermediate portion 116 for further processing.

The second input port 112*b* can be further coupled to the second detector 114*b* and the second combiner 114*d*. Specifically, the second detector 114*b* and the second combiner 114*d* can be coupled to the second input port 112*b* in a manner such that the second input signal can be received by the second detector 114*b* and the second combiner 114*d*. The second detector 114*b* can also be coupled to the second combiner 114*d*. The second detector 114*b* can be further coupled to the first combiner 114*c*. The second detector 114*b* can be configured to receive and process the second input signal in a manner so as to produce a second preliminary signal. The second preliminary signal can be communicated from the second detector 114*b* to the first combiner 114*c*. Moreover. as will be discussed later in further detail, the second input port 112*b* can yet be further coupled to the intermediate portion 116 in a manner such that the second input signal can be communicated to the intermediate portion 116 for further processing.

Earlier mentioned, the input portion 114 can be configured to process a set of input signals in a manner so as to produce processed input signals. The processed input signals produced by the input portion 114 can include a first processed input signal and a second processed input signal. Processing of the input signals by the input portion 114 to produce processed input signals will be described in further detail hereinafter.

Each of the first and second detectors 114*a*/114*b* can, for example, be a root mean square (RMS) detector. The first and second detectors 114*a*/114*b* can be capable of determining the RMS characteristic of the first input signal and the RMS characteristic of the second input signal respectively. Thus the first and second preliminary signals can be indicative of the RMS characteristic of the first input signal and the RMS characteristic of the second input signal respectively.

The first combiner 114*c* can be configured to receive and process the first input signal and the second preliminary signal in a manner so as the combine the first input and second preliminary signals. The first combiner 114*c* can, for example, be configured to process the first input and second preliminary signals in a manner such that both signals are combined via multiplication. In this regard, the first combiner 114*c* can, for example, be a multiplier. Thus the first processed input signal can correspond to the product of the first input and second preliminary signals.

The second combiner 114*d* can be configured to receive and process the second input signal and the first preliminary signal in a manner so as the combine the second input and first preliminary signals. The second combiner 114*d* can, for example, be configured to process the second input and first preliminary signals in a manner such that both signals are combined via multiplication. In this regard, the second combiner 114*d* can, for example, be a multiplier. Thus the second processed input signal can correspond to the product of the second input and first preliminary signals.

The first and second processed input signals can respectively be communicated from the first and second combiners 114*c*/114*d* to the intermediate portion 116 for further processing as will be discussed in further detail hereinafter. Additionally, earlier mentioned, the first and second input ports 112*a*/112*b* can be coupled to the intermediate portion 116 such that the first and second input signals can be communicated to the intermediate portion 116 for further processing.

The intermediate portion 116 includes a set of mixers which can be configured to produce a corresponding set of mixed signals. As shown, the set of mixers can include a first intermediate mixer 116*a*, a second intermediate mixer 116*b* and a third intermediate mixer 116*c*. The first, second and third intermediate mixers 116*a*/116*b*/116*c* can be configured to produce a first mixed signal, a second mixed signal and a third mixed signal respectively. In this regard, the set of mixed signals can include the first, second and third mixed signals. Additionally, the intermediate portion 116 can further include a compensator 116*d*. The compensator 116*d* can be configured to produce a compensated signal.

The first intermediate mixer 116*a* can be coupled to the first input port 112*a*. The second intermediate mixer 116*b* can be coupled to the second input port 112*b*. The third intermediate mixer 116*c* can be coupled to the first and second combiners 114*c*/114*d*. The third intermediate mixer 116*c* can be further coupled to the compensator 116*d*. The compensator 116*d* can be further coupled to the first and second intermediate mixers 116*a*/116*b*. Moreover, the first intermediate mixer 116*a*, the second intermediate mixer 116*b* and the compensator 116*d* can be coupled to the output portion 118 as will be discussed later in further detail. In this regard, the aforementioned set of intermediate signals can include the first mixed signal, the second mixed signal and at least a portion of the compensated signal or any combination thereof.

The first and second input signals can respectively be communicated from the first and second input ports 112*a*/112*b* to the first and second intermediate mixers 116*a*/116*b* respectively. Additionally, the first and second processed input signals can respectively be communicated from the first and second combiners 114*c*/114*d* to the third intermediate mixer 116*c*.

Based on the first and second processed input signals, the third intermediate mixer 116*c* can be configured to produce the third mixed signal. Specifically, the third intermediate mixer 116*c* can be configured to receive and process the first and second processed input signals in a manner so as to produce the third mixed signal. More specifically, the third intermediate mixer 116*c* can be configured to process the first and second processed input signals in a manner so as to mix both signals. The third intermediate mixer 116*c* can, for example, be configured to process the first and second processed input signals such that the first processed input signal is in-phase with respect to the second processed input signal. Thus, the first and second processed input signals can be processed by the third intermediate mixer 116*c* via in-phase processing. In this regard, the third intermediate mixer 116*c* can, for example, be an adder. Thus the third mixed signal can, for example, correspond to the summation of the first and second processed input signals.

The third mixed signal can be communicated from the third intermediate mixer 116*c* to the compensator 116*d* for further processing. Specifically, the compensator 116*d* can be configured to receive and process the third mixed signal in a manner so as to produce a compensated signal. The compensator 116*d* can, for example, be a compressor associated with a compression ratio of 2:1. In this regard, the compensator 116*d* can process the third mixed signal in a manner so as to compress the third mixed signal. Thus the compensated signal can correspond to the compression of the third mixed signal.

Based on the first input signal and at least a portion of the compensated signal, the first intermediate mixer 116*a* can be configured to produce the first mixed signal. Specifically, the first intermediate mixer 116*a* can be configured to receive and process the first input signal and at least a portion of the compensated signal in a manner so as to produce the first mixed signal. More specifically, the first intermediate mixer 116*a* can be configured to process the first input signal and at least a portion of the compensated signal in a manner so as to mix both signals. The first intermediate mixer 116*a* can, for example, be configured to process the first input signal and at least a portion of the compensated signal such that the first input signal is out-of-phase with respect to the at least a portion of the compensated signal. Thus, the first input signal and at least a portion of the compensated signal can be processed by the first intermediate mixer 116*a* via out-of-phase processing. In this regard, the first intermediate mixer 116*a* can, for example, be a subtractor. Thus the first mixed signal can, for example, correspond to the subtraction of at least a portion of the compensated signal from the first input signal.

Based on the second input signal and at least a portion of the compensated signal, the second intermediate mixer 116*b* can be configured to produce the second mixed signal. Specifically, the second intermediate mixer 116*b* can be configured to receive and process the second input signal and at least a portion of the compensated signal in a manner so as produce the second mixed signal. More specifically, the second intermediate mixer 116*b* can be configured to process the second input signal and at least a portion of the compensated signal in a manner so as to mix both signals. The second intermediate mixer 116*b* can, for example, be configured to process the second input signal and at least a portion of the compensated signal such that the second input signal is out-of-phase with respect to the at least a portion of the compensated signal. Thus, the second input signal and at least a portion of the compensated signal can be processed by the second intermediate mixer 116*b* via out-of-phase processing. In this regard, the second intermediate mixer 116*b* can, for example, be a subtractor. Thus the second mixed signal can, for example, correspond to the subtraction of at least a portion of the compensated signal from the second input signal.

The first intermediate mixer 116*a*, the second intermediate mixer 116*b* and the compensator 116*d* can be coupled to the output portion 118 in a manner such that the first mixed signal, the second mixed signal and at least a portion of the compensated signal can be communicated to the output portion 118 for further processing as will be discussed in further detail hereinafter with reference to FIG. 1*c* and FIG. 1*d*.

Figure 1C:
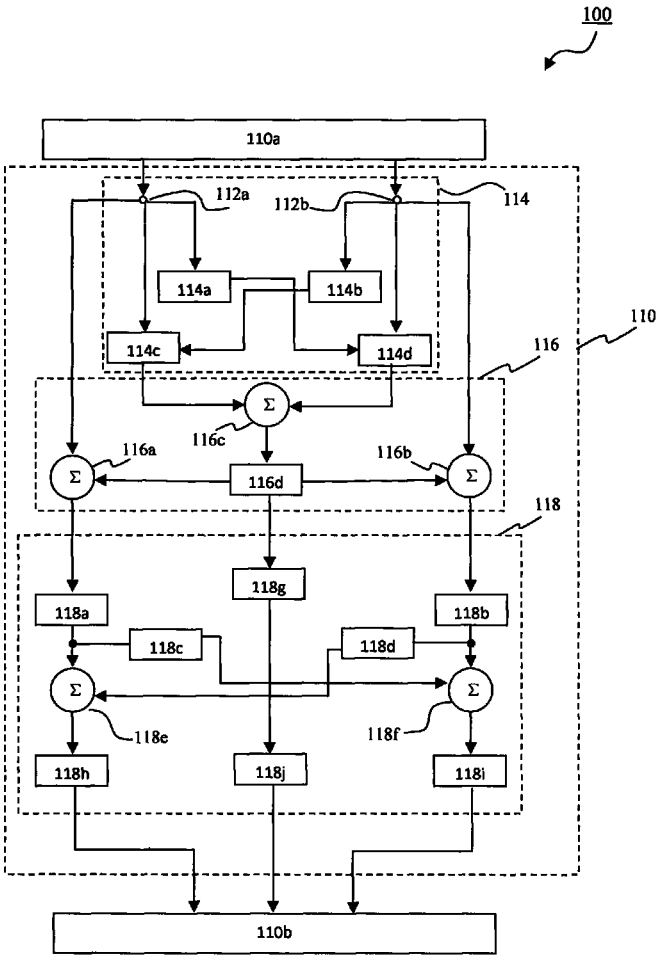
FIG. 1*c* shows a first exemplary implementation of the output portion of FIG. 1*a*, according to an embodiment of the disclosure.

FIG. 1*c* shows a first exemplary implementation of the output portion 118. FIG. 1*d* shows a second exemplary implementation of the output portion 118.

Referring to FIG. 1*c*, in the first exemplary implementation, the output portion 118 can include a first frequency processing portion 118*a*, a second frequency processing portion 118*b*, a first filter 118*c*, a second filter 118*d*, a first output mixer 118*e* and a second output mixer 118*f*. The output portion 118 can further include a third frequency processing portion 118*g*, a first driver 118*h*, a second driver 118*i* and a third driver 118*j*.

The first and second frequency processing portions 118*a*/118*b* can be coupled to the first and second intermediate mixers 116*a*/116*b* respectively. The first frequency processing portion 118*a* can be further coupled to the first filter 118*c* and the first output mixer 118*e*. The second frequency processing portion 118*b* can be further coupled to the second filter 118*d* and the second output mixer 118*f*. The first filter 118*c* can be further coupled to the second output mixer 118*f*. The second filter 118*d* can be further coupled to the first output mixer 118*e*. The first and second output mixers 118*e*/118*f* can be further coupled to the first and second drivers 118*h*/118*i* respectively.

The third frequency processing portion 118*g* can be coupled to the compensator 116*d*. The third frequency processing portion 118*g* can be further coupled to the third driver 118*j*.

Each of the first, second and third drivers 118*h*/118*i*/118*j* can be further coupled to the output module 110*b*.

The first, second and third frequency processing portions 118*a*/118*b*/118*g* can be configured to receive and process the first mixed signal, the second mixed signal and at least a portion of the compensated signal respectively in a manner so as to manipulate the frequency response of the first mixed signal, the second mixed signal and at least a portion of the compensated signal. Thus the first, second and third frequency processing portions 118*a*/118*b*/118*g* can respectively be configured to process the first mixed signal, the second mixed signal and at least a portion of the compensated signal to respectively produce a first frequency processed signal, a second frequency processed input signal and a third frequency processed signal.

Each of the first, second and third frequency processing portions 118*a*/118*b*/118*g* can, for example, be an equalizing (EQ) filter configured to manipulate frequency response of the first mixed signal, the second mixed signal and at least a portion of the compensated signal respectively. For example, frequency response of the first mixed signal, the second mixed signal and at least a portion of the compensated signal can respectively be manipulated by the first, second and third frequency processing portions 118*a*/118*b*/118*g*, by way of compensation for unequal frequency response or creative alteration of the frequency response, such that fidelity of the first and second mixed signals and at least a portion of the compensated signal can be improved.

The first and second filters 118*c*/118*d* can be configured to respectively receive and process the first and second frequency processed signals in a manner so as to produce, respectively, a first filter processed signal and a second filter processed signal. Each of the first and second filters 118*c*/118*d* can, for example, be a low pass filter (LPF). The LPF can be associated with filter characteristics such as filter type and filter cut-off frequency. For example, each of the first and second filters 118*c*/118*d* can be of a filter type corresponding to a first-order Butterworth LPF. The first-order Butterworth LPF can, for example, have a filter cut off frequency between 1 kHz and 3 kHz.

The first output mixer 118*e* can be configured to receive and process the first frequency processed signal and the second filter processed signal in a manner so as to produce a first driving signal. The second output mixer 118*f* can be configured to receive and process the second frequency processed signal and the first filter processed signal in a manner so as to produce a second driving signal. Each of the first and second output mixers 118*e*/118*f* can be analogous to any of the aforementioned first, second and third intermediate mixers 116*a*/116*b*/116*c*. In this regard, where appropriate, the foregoing pertaining to the first, second and third intermediate mixers 116*a*/116*b*/116*c* analogously applies to the first and second output mixers 118*e*/118*f*.

Additionally, the third frequency processed signal can be a third driving signal.

The first, second and third driving signals can be communicated to the first, second and third drivers 118*h*/118*i*/118*j* respectively. Based on the first, second and third driving signals, the first, second and third drivers 118*h*/118*i*/118*j* can be configured to produce a first output signal, a second output signal and a third output signal respectively as will be discussed in further detail hereinafter.

The first driver 118*h* can, for example, receive and process the first driving signal in a manner so as to one of attenuate and amplify the first driving signal. In this regard, the first driver 118*h* can, in one example, be a power amplifier which can be powered by a constant voltage source. Thus the first output signal can correspond to one of an attenuated first driving signal and an amplified first driving signal. Therefore, the first driver 118*h* can be associated with a constant corresponding to one of an attenuation factor and an amplification factor for correspondingly one of attenuating and amplifying the first driving signal.

The first driver 118*h* can, in another example, be a buffer amplifier or a unity gain buffer. In this regard, the first driver 118*h* can be associated with a constant corresponding to a unity factor such that the first driving signal is neither attenuated nor amplified. Thus the unity factor can be a gain factor corresponding to numeral "1" (i.e., unity gain).

Each of the second and third drivers 118*i*/118*j* can be analogous to the first driver 118*h*. In this regard, where appropriate, the foregoing discussion pertaining to the first driver 118*h* analogously applies to the second and third drivers 118*i*/118*j*.

Earlier mentioned, a set of output signals can be communicated from the output portion 118 to the output module 110*b*. The set of output signals can include the first, second and third output signals which can be communicated from the output portion 118 to the output module 110*b* via the first, second and third drivers 118*h*/118*i*/118*j* respectively.

Figure 1D:
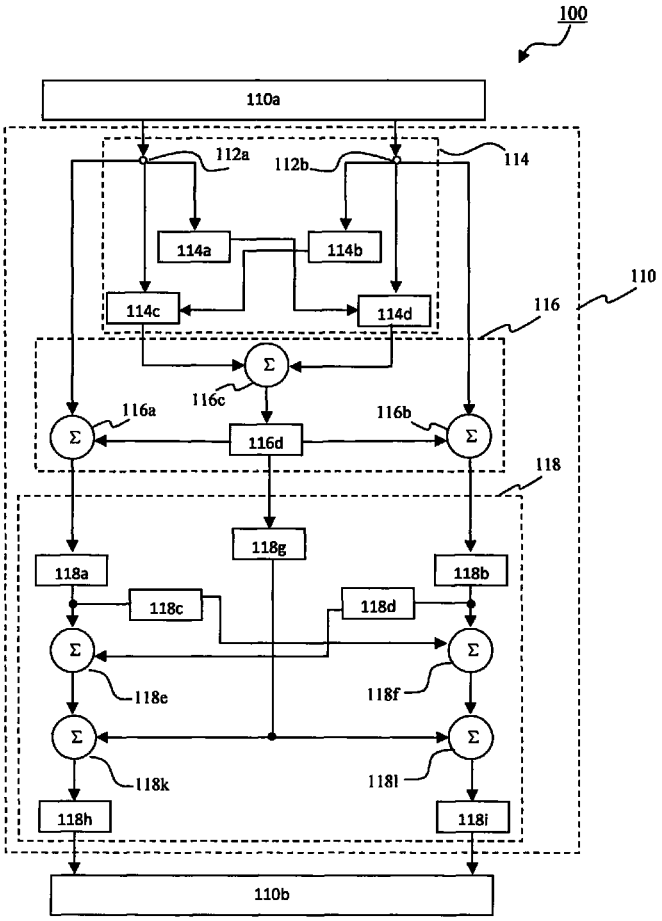
FIG. 1*d* shows a second exemplary implementation of the output portion of FIG. 1*a*, according to an embodiment of the disclosure.

Referring to FIG. 1*d*, in the second exemplary implementation, the output portion 118 can, as with the first exemplary implementation, include the aforementioned first frequency processing portion 118*a*, the aforementioned second frequency processing portion 118*b*, the aforementioned first filter 118*c*, the aforementioned second filter 118*d*, the aforementioned first output mixer 118*e*, the aforementioned second output mixer 118*f*, the aforementioned third frequency processing portion 118*g*, the aforementioned first driver 118*h* and the aforementioned second driver 118*i*. In this regard, where appropriate, the foregoing as discussed in relation to the first exemplary implementation analogously applies.

Moreover, in the second exemplary implementation, the output portion 118 can further include a third output mixer 118*k* and a fourth output mixer 118*l*. The third output mixer 118*k* can be coupled to the first output mixer 118*e* and the fourth output mixer 118*l* can be coupled to the second output mixer 118*f*. Additionally, each of the third and fourth output mixers 118*k*/118*l* can be coupled to the third frequency processing portion 118*g*.

Each of the third and fourth output mixers 118*k*/118*l* can be analogous to any of the aforementioned first, second and third intermediate mixers 116*a*/116*b*/116*c*, and the aforementioned first and second output mixers 118*e*/118*f*. In this regard, the foregoing discussion in relation to any of the aforementioned first, second and third intermediate mixers 116*a*/116*b*/116*c*, and the aforementioned first and second output mixers 118*e*/118*f* analogously applies.

The third output mixer 118*k* can be configured to receive and process the first driving signal and at least a portion of the third frequency processed signal in a manner so as to produce a first combined driving signal. Earlier mentioned, the third frequency processed signal can be a third driving signal. For example, the third output mixer 118*k* can be an adder which can be configured to receive and process the first driving signal and one half of the third driving signal. Thus the first combined driving signal can, for example, correspond to the summation of the first driving signal and one half of the third driving signal.

The fourth mixer 118*l* can be configured to receive and process the second driving signal and at least a portion of the third frequency processed signal in a manner so as to produce a second combined driving signal. Earlier mentioned, the third frequency processed signal can be a third driving signal. For example, the fourth output mixer 118*l* can be an adder which can be configured to receive and process the second driving signal and one half of the third driving signal. Thus the second combined driving signal can, for example, correspond to the summation of the second driving signal and one half of the third driving signal.

The first and second combined driving signals can be communicated respectively from the third and fourth mixers 118*k*/118*l* to the first and second drivers 118*h*/118*i* respectively. Based on the first and second combined driving signals, the first and second drivers 118*h*/118*i* can respectively be configured to produce a first output signal and a second output signal in a manner analogous to the first exemplary implementation as discussed earlier.

Earlier mentioned, a set of output signals can be communicated from the output portion 118 to the output module 110*b*. The set of output signals can include the first and second output signals which can be communicated from the output portion 118 to the output module 110*b* via the first and second drivers 118*h*/118*i* respectively.

Figure 1E:
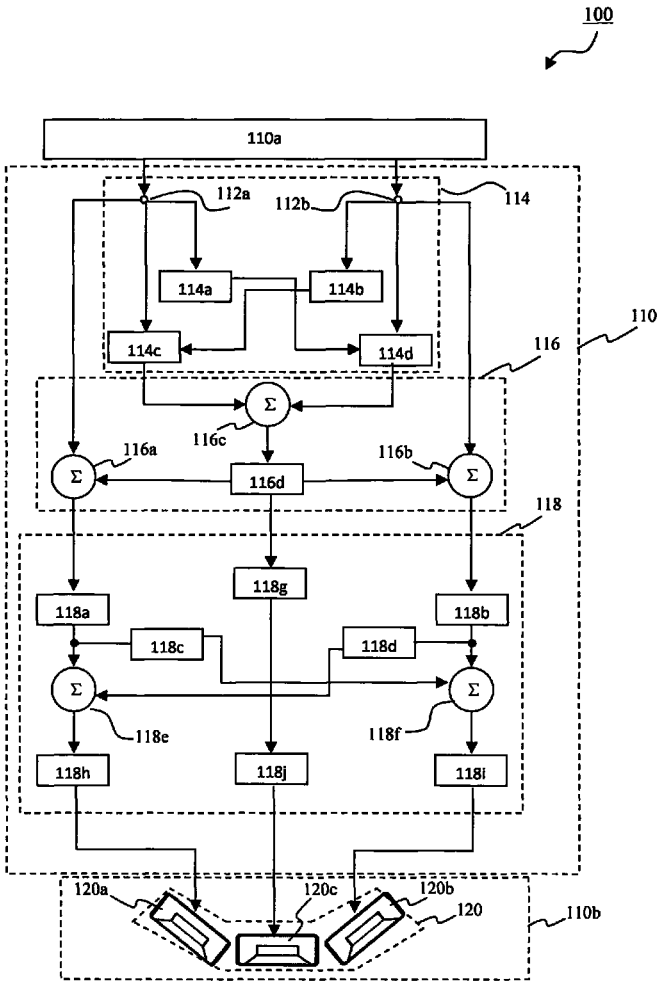
FIG. 1*e* shows the a first exemplary configuration of the output module of FIG. 1*a* which is suitable for operation with the first exemplary implementation of the output portion according to FIG. 1*c;*
Figure 1F:
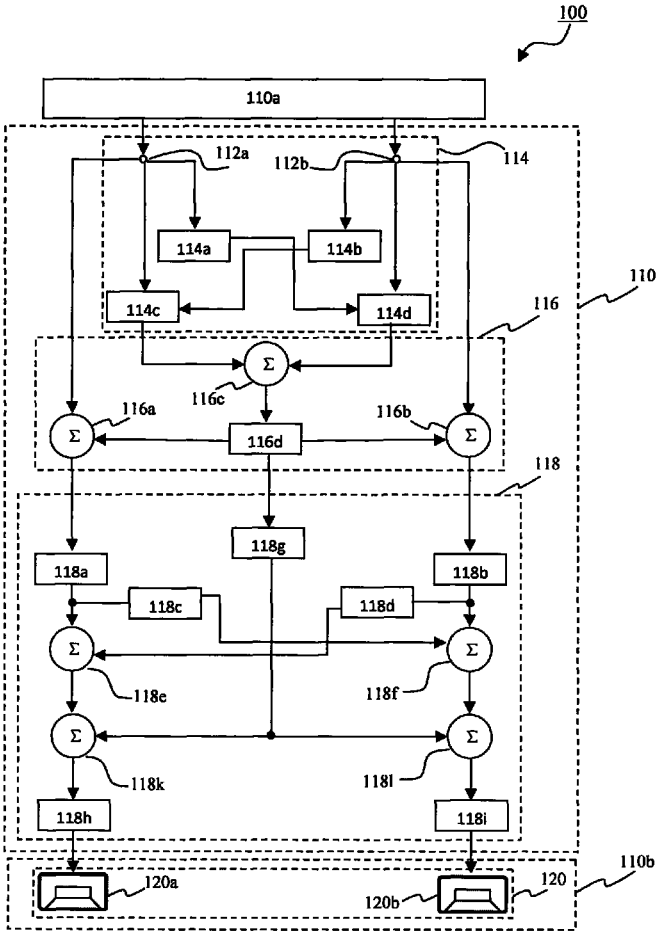
FIG. 1*f* shows a second exemplary configuration of the output module of FIG. 1*a* which is suitable for operation with the second exemplary implementation of the output portion according to FIG. 1*d;*

Referring to FIG. 1*e* and FIG. 1*f*, the output module 100*b* can, for example, be a speaker system which includes a speaker array 120. FIG. 1*e* shows a first exemplary configuration of the speaker array 120 and FIG. 1*f* shows a second exemplary configuration of the speaker array 120.

Referring to FIG. 1*e*, in the first exemplary configuration, the speaker array 120 can, for example, be a three speaker array having a first speaker 120*a*, a second speaker 120*b* and a third speaker 120*c* such that the speaker array 120 can be suitable for operation with the first exemplary implementation of the output portion 118 as discussed with reference to FIG. 1*c*.

The first, second and third speakers 120*a*/120*b*/120*c* can be coupled to the processing apparatus 110 in a manner so as to receive the first, second and third output signals respectively. Specifically, the first speaker 120*a* can be coupled to the first driver 118*h*, the second speaker 120*b* can be coupled to the second driver 118*i* and the third speaker 120*c* can be coupled to the third driver 118*j*. Thus the first, second and third output signals can drive the first, second and third speakers 120*a*/120*b*/120*c* respectively.

Earlier mentioned, based on the set of output signals, the output module 100*b* can be configured to produce a set of reproduction signals.

More specifically, based on the first, second and third output signals, the respective first, second and third speakers 120*a*/120*b*/120*c* can be configured to produce a first reproduction signal, a second reproduction signal and a third reproduction signal respectively.

In one exemplary scenario, the first and second input signals correspond to a left audio signal and a right audio signal respectively. Additionally the aforementioned mentioned first, second and third speakers 120*a*/120*b*/120*c* of the speaker array 120 can correspond to a left speaker, a right speaker and a center speaker, respectively, of the speaker array 120. The left, right and center speakers can each be associated with a speaker output.

In this regard, the first and second input signals can be denoted by symbols "$L_{in}$" and "$R_{in}$" respectively. Additionally, the first and second input signals can respectively be represented by formulas (1a) and (1b) as follows:

$$L_{in}=A\cos\phi \tag{1a}$$

$$R_{in}=A\sin\phi \tag{1b}$$

The symbol "A" represents amplitude of each of the left and right audio signals. The symbol "ϕ" relates generally to audio panning. Particularly, based on "ϕ", stereo width of a stereo signal, which can be based on $L_{in}$, and $R_{in}$, can be adjusted.

In one example, where "ϕ" corresponds to an angle of zero degree, $L_{in}$=A and $R_{in}$=0. Thus the set of reproduction signals from the output module 100*b* can be based on only the left audio signal. In another example, where "ϕ" corresponds to an angle of ninety degrees, $L_{in}$=0 and $R_{in}$=A. Thus the set of reproduction signals from the output module 100*b* can be based on only the right audio signal.

The first and second preliminary signals, which can be indicative of the RMS characteristic of the first input signal and the RMS characteristic of the second input signal respectively, can be denoted by symbols "$\tilde{L}_{in}$" and "$\tilde{R}_{in}$" respectively.

The first and second processed input signals, denoted by symbols "$V_1$" and "$V_2$" respectively, can be represented by formulas (2a) and (2b) respectively as follows:

$$V_1=L_{in}\tilde{R}_{in} \tag{2a}$$

$$V_2=R_{in}\tilde{L}_{in} \tag{2b}$$

Furthermore, the compensated signal, which can be associated with the third driving signal which can be based upon to produce the third output signal for driving the center speaker, can be denoted by symbol "$C_D$" and can be represented by formula (3) as follows:

$$C_D=\frac{\sqrt{2}}{A}\left(L_{in}\tilde{R}_{in}+R_{in}\tilde{L}_{in}\right) \tag{3}$$

The first mixed signal, which can be associated with the first driving signal which can be based upon to produce the first output signal for driving the left speaker, can be denoted by symbol "$L_D$" and can be represented by formula (4) as follows:

$$L_D=L_{in}-C_D/2 \tag{4}$$

The second mixed signal, which can be associated with the second driving signal which can be based upon to produce the second output signal for driving the right speaker, can be denoted by symbol "$R_D$" and can be represented by formula (5) as follows:

$$R_D=R_{in}-C_D/2 \tag{5}$$

Additionally, the first and second filter processed signals can be denoted by symbols "$L'_{in}$" and "$R'_{in}$" respectively.

The first and second output signals which respectively drive the left and right speakers can be denoted by symbols "$L_{out}$" and "$R_{out}$" respectively. Assuming the first and second drivers 118*h*/118*i* are each associated with a constant corresponding to a unity factor, the first and second output signals can be represented by formulas (6) and (7) respectively as follows:

$$L_{out}=L_D-R'_{in} \tag{6}$$

$$R_{out}=R_D-L'_{in} \tag{7}$$

Additionally, the third output signal which drives the center speaker can be denoted by symbol "$C_{out}$". Assuming the third driver 118*j* is associated with a constant corresponding to a unity factor, the third output signal can be represented by formula (8) as follows:

$$C_{out}=\frac{\sqrt{2}}{A}\left(L_{in}\tilde{R}_{in}+R_{in}\tilde{L}_{in}\right) \tag{8}$$

As can be noted from formula (3), $C_D$ can be based on the addition of the first and second processed input signals. The first and second processed input signals can be represented by formulas (2a) and (2b) respectively. Furthermore, it is understood that amplitude of $C_D$ as shown in formula (3) can be varied. More specifically, the amplitude of $C_D$ as represented by $$\frac{\sqrt{2}}{A}$$

in formula (3) can be varied by, for example, any one of the input portion 114, the third mixer 116*c* and the compensator 116*d*, or the combination thereof.

Additionally, as can be noted from formulas (3), (4) and (5), one half of $C_D$ as shown in formula (3), $C_D/2$, can be subtracted from each of the first and second input signals, as shown in formulas (4) and (5) respectively. It is understood that subtraction of $C_D$, more particularly extent to which $C_D$ can be subtracted, from each of the first and second input signals can be varied and need not necessarily be limited to one half thereof. Extent to which $C_D$ is subtracted, from each of the first and second input signals can be varied via, for example, any of the first mixer 116*a*, the second mixer 116*b*, the third mixer 116*c* and the compensator 116*d*, or any combination thereof, as appropriate.

In this manner, each of the first and second mixed signals can be based on subtraction of at least a portion of $C_D$.

Moreover, as will be discussed later in further detail with reference to FIG. 5, based on the first and second output signals, as represented by "$L_{out}$," of formula (6) and "$R_{out}$" of formula (7) respectively, the aforementioned stereo width can be effectively widened.

Referring to FIG. 1*f*, in the second exemplary configuration, the speaker array 120 can, for example, be a two speaker array having the aforementioned first speaker 120*a* and the aforementioned second speaker 120*b* such that the speaker array 120 can be suitable for operation with the second exemplary implementation of the output portion 118 as discussed in FIG. 1*d*.

Based on the exemplary scenario discussed with reference to FIG. 1*e*, the first and second combined driving signals can be denoted by symbols "$L_{com}$" and "$R_{com}$" respectively, and can respectively be represented by formulas (9) and (10) as follows:

$$L_{com}=(L_D-R'_{in})+C_D/2 \tag{9}$$

$$R_{com}=(R_D-L'_{in})+C_D/2 \tag{10}$$

Assuming the first and second drivers 118*h*/118*l* are each associated with a constant corresponding to a unity factor, the first and second output signals can be represented by formulas (11) and (12) respectively as follows:

$$L_{out}=L_{com}=(L_D-R'_{in})+C_D/2 \tag{11}$$

$$R_{out}=R_{com}=(R_D-L'_{in})+C_D/2 \quad (12)$$

The system 100, more particularly the speaker output of each of the first, second and third speakers 120*a*/120*b*/120*c* of the speaker array 120 according to the first exemplary configuration, will be discussed in further detail hereinafter with respect to FIG. 2*a* and FIG. 2*b*, in relation to the exemplary scenario mentioned in FIG. 1*e*.

Earlier mentioned, the first, second and third speakers 120*a*/120*b*/120*c* of the speaker array 120 can correspond respectively to a left speaker, a right speaker and a center speaker of the speaker array 120. The speaker output of the center speaker of the speaker array 120 will be discussed in further detail with reference to FIG. 2*a*. The speaker outputs of the left and right speakers of the speaker array 120 will be discussed in further detail with reference to FIG. 2*b*.

Figure 2A:
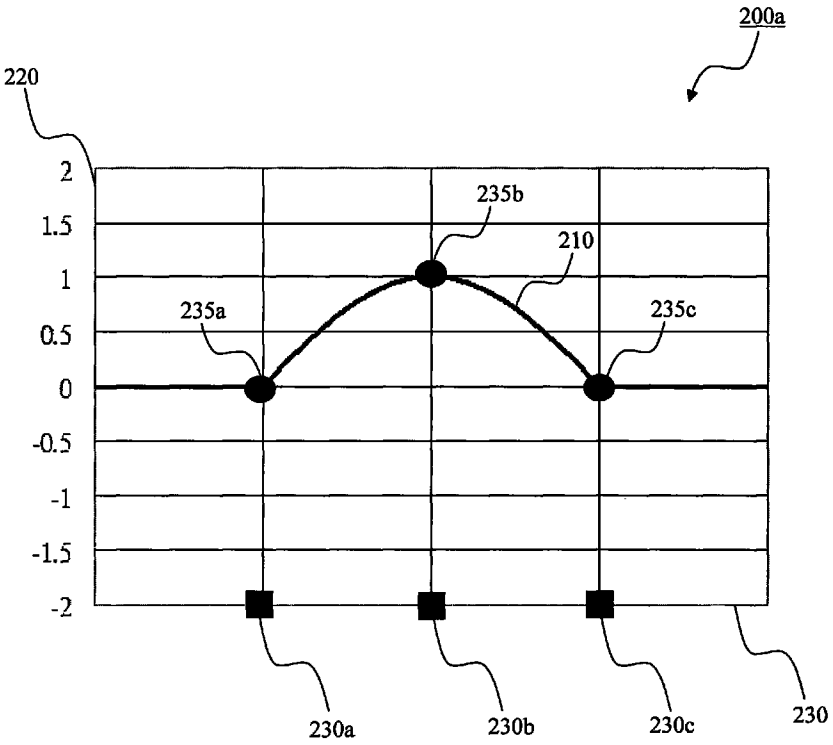
FIG. 2*a* shows a first graph in which a center profile is illustrated.

FIG. 2*a* shows a first graph 200*a* in which a center profile 210 is illustrated. The first graph 200*a* includes an amplitude axis 220 and a source indication axis 230. The amplitude axis 220 can be indicative of normalized amplitude of speaker output. The source indication axis 230 is indicative of output source. The output source includes, for example, the left, center and right speakers. The source indication axis 230 includes a first indication point 230*a*, a second indication point 230*b* and a third indication point 230*c* corresponding to the left, center and right speakers respectively.

Additionally, the first graph 200*a* includes a first data point 235*a*, a second data point 235*b* and a third data point 235*c*. The first, second and third data points 235*a*/235*b*/235*c* are indicative of normalized amplitude of speaker output of the left, center and right speakers, respectively, of the speaker array 120.

The center profile 210 can be representative of $C_{out}$ of formula (8). Thus the center profile 210 can be indicative of the speaker output of the center speaker of the speaker array 120. More specifically, the center profile 210 can be indicative of the third reproduction signal.

As can be observed from the center profile 210, it is notable that the second indication point 230*b* corresponds to a normalized amplitude numeral "1" as indicated by the second data point 235*b*. Each of the first and third indication points 230*a*/230*c* corresponds to a normalized amplitude numeral "0" as indicated by respective first and third data points 235*a*/235*c*.

Thus, with respect to the speaker output of the center speaker, the third reproduction signal can be considered substantially distinct from the first and second reproduction signals. Specifically, the first and second reproduction signals can be considered substantially absent from the speaker output of the center speaker. More specifically, the third reproduction signal can be substantially differentiated from the first and second reproduction signals.

Figure 2B:
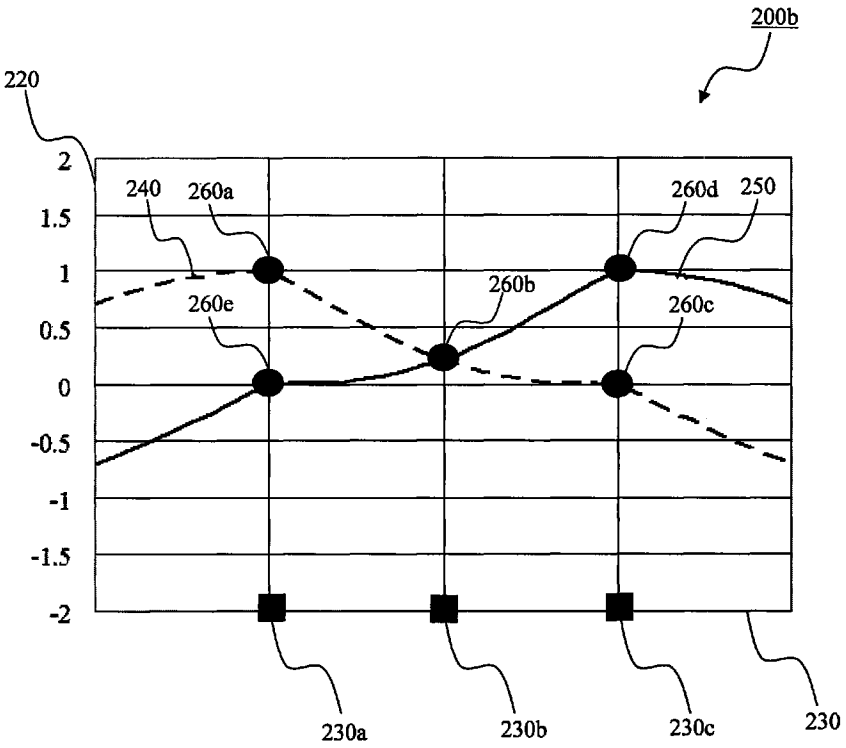
FIG. 2*b* shows a second graph in which a left profile and a right profile are illustrated.

FIG. 2*b* shows a second graph 200*b* in which a left profile 240 and a right profile 250 are illustrated. Similar to the first graph 200*a*, the second graph 200*b* includes the amplitude axis 220 and the source indication axis 230. Additionally, the second graph 200*b* includes a first data label 260*a*, a second data label 260*b*, a third data label 260*c*, a fourth data label 260*d* and a fifth data label 260*e*.

With respect to the left profile 240, the first, second and third data labels 260*a*/260*b*/260*c* are indicative of normalized amplitude of speaker output of the left, center and right speakers, respectively, of the speaker array 120.

With respect to the right profile 250, the fourth, second and fifth data labels 260*d*/260*b*/260*e* are indicative of normalized amplitude of speaker output of the right, center and left speakers, respectively, of the speaker array 120.

The left and right profiles 240/250 can respectively be representative of $L_{out}$ and $R_{out}$ of formulas (6) and (7) respectively. Thus the left and right profiles 240/250 can be respectively indicative of the speaker outputs of the left and right speakers of the speaker array 120. More specifically, the left and right profiles 240/250 can respectively be indicative of the first and second reproduction signals respectively.

As can be observed from the left profile 240, it is notable that the first indication point 230*a* corresponds to a normalized amplitude numeral "1" as indicated by the first data label 260*a*. Additionally, the second indication point 230*b* corresponds to a normalized amplitude approaching numeral "0" as indicated by the second data label 260*b* and the third indication point 230*c* corresponds to a normalized amplitude numeral "0" as indicated by the third data label 260*c*.

Furthermore, as can be observed from the right profile 250, it is notable that the third indication point 230*c* corresponds to a normalized amplitude numeral "1" as indicated by the fourth data label 260*d*. Additionally, the second indication point 230*b* corresponds to a normalized amplitude approaching numeral "0" as indicated by the second data label 260*b* and the first indication point 230*a* corresponds to a normalized amplitude numeral "0" as indicated by the fifth data label 260*e*.

With regard to both the left and right profiles 240/250, since the second indication point 230*b* corresponds to a normalized amplitude approaching numeral "0" as indicated by the second data label 260*b*, the speaker output from the center speaker can be considered negligible.

Appreciably, based on the left profile 240, the second and third reproduction signals can be considered absent from the speaker output of the left speaker. Similarly, based on the right profile 250, the first and third reproduction signals can be considered absent from the speaker output of the right speaker.

Thus, with respect to the speaker output of the left speaker, the first reproduction signal can be considered substantially distinct from the second and third reproduction signals. Specifically, the second and third reproduction signals can be considered substantially absent from the speaker output of the left speaker. More specifically, the first reproduction signal can be substantially differentiated from the second and third reproduction signals.

Additionally, with respect to the speaker output of the right speaker, the second reproduction signal can be considered substantially distinct from the first and third reproduction signals. Specifically, the first and third reproduction signals can be considered substantially absent from the speaker output of the right speaker. More specifically, the second reproduction signal can be substantially differentiated from the first and third reproduction signals.

Therefore, based on the center, left and right profiles 210/240/250 as illustrated in FIG. 2*a* and FIG. 2*b*, the speaker output of each of the left, right and center speakers can be considered substantially distinct from one another. In this manner, cross-talk between the left, right and center speakers of the speaker array 120 can be mitigated.

In this regard, a listener, via the system 100, can be capable of substantially distinguishing the first, second and third reproduction signals regardless of positioning of the listener with respect to the first, second and third speakers 120*a*/120*b*/120*c* of the speaker array 120. Thus appreciably, the area within which the listener is fully capable of experiencing the aforementioned faithful reproduction need not be unduly limited. Thus the "sweet spot" in respect of the system 100 can be enlarged as compared with the "sweet spot" in respect of conventional speaker systems.

Additionally, widening of the aforementioned stereo width can also facilitate expansion of the area within which the listener is fully capable of experiencing the aforementioned faithful reproduction.

Specifically, as mentioned earlier, the aforementioned stereo width can be effectively widened based on the first and second output signals. The combination of a widened stereo width and the third reproduction signal from the third speaker 120*c* facilitates expansion of the area within which the listener is fully capable of experiencing the aforementioned faithful reproduction. Thus the "sweet spot" in respect of the system 100 can be enlarged as compared with the "sweet spot" in respect of conventional speaker systems.

Furthermore, listener experience enhancement, in respect of enlarging the "sweet spot", can be facilitated in a substantially more efficient manner as compared with conventional complex speaker systems in which more than three speakers strategically positioned around the listener may be necessary.

Specifically, since the aforementioned stereo width can effectively be widened, and the first, second and third reproduction signals as perceived by the listener from, respectively, the first, second and third speakers 120*a*/120*b*/120*c* can be capable of being substantially distinguished regardless of positioning of the listener with respect to the speaker array 120, it is appreciable that not more than three speakers may be required for the speaker array 120 of the system 100.

Figure 3:
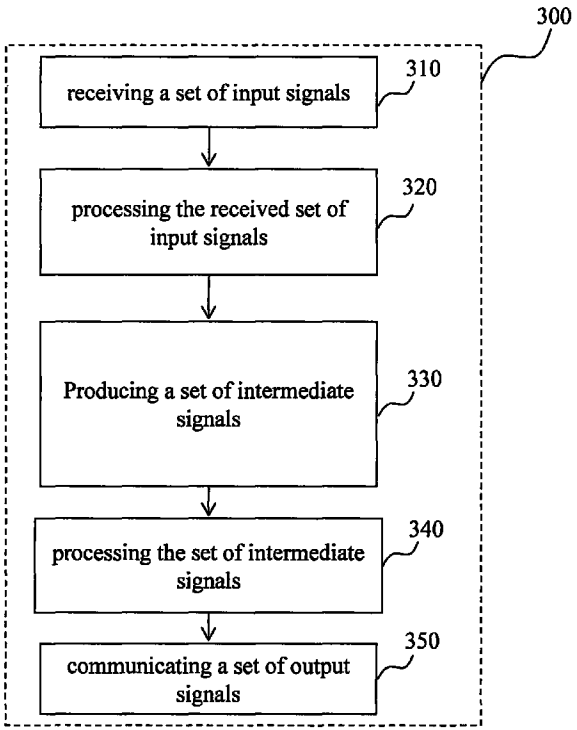
FIG. 3 is a flow diagram illustrating a processing method in association with the system of FIG. 1*a;*

FIG. 3 is a flow diagram illustrating a processing method 300 in association with the system 100. Earlier mentioned, a set of input signals can be processed by the apparatus 110 in a manner so as to produce a set of output signals.

The processing method 300 includes receiving a set of input signals 310. The set of input signals can be received from the input module 100*a* via the input portion 114.

The processing method 300 also includes processing the received set of input signals 320. The set of input signals received can be processed in a manner so as to produce processed input signals. The input signals can be received and processed at the input portion 114 in a manner so as to produce processed input signals.

Furthermore, the processing method 300 includes producing a set of intermediate signals 330. The intermediate portion 116 can be configured to receive the set of input signals and the processed input signals for processing in a manner so as to produce a set of intermediate signals.

The processing method 300 can optionally include processing the set of intermediate signals 340. The output portion 118 can be configured to receive and process the set of intermediate signals in a manner so as to produce a set of output signals.

The processing method 300 can also optionally include communicating a set of output signals 350. The set of output signals can be communicated from the output portion 118 to the output module 110*b*. Based on the set of output signals, the output module 100*b* can be configured to produce a set of reproduction signals.

Figure 4:
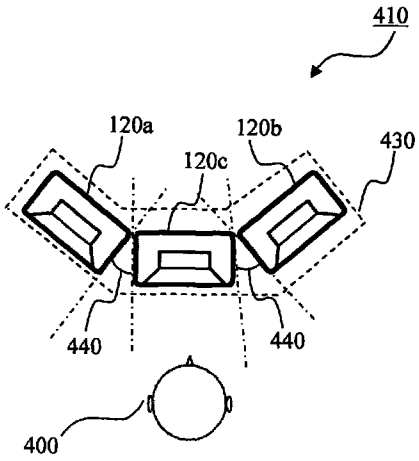
FIG. 4 shows an exemplary orientation of a speaker array which can be included in the output module of FIG. 1*a*.

FIG. 4 shows an exemplary orientation of the first exemplary configuration of the speaker array 120 as discussed with reference to FIG. 1*e*.

In the exemplary orientation, the first, second and third speakers 120*a*/120*b*/120*c* can be packaged in a chassis or a housing 430 so as to form a speaker system.

Particularly, the third speaker 120*c* can be positioned such that it faces the listener 400. Additionally, each of the first and second speakers 120*a*/120*b* can be positioned such that they are tilted at a tilt angle 440 with respect to the third speaker 120*c* and facing away from the listener 400. The tilt angle 440 can, for example, be of a value within a range of 0 degree and 90 degrees. More specifically, the tilt angle 440 can be of a value within a range of 15 degrees and 60 degrees.

Thus it is appreciable that the first and second speakers 120*b*/120*c* can be flexibly positioned in a manner such that they can be tilted at an angle 440, as desired, with respect to the third speaker 120*c*.

Therefore it is appreciable that the manner in which the set of input signals is processed by the processing apparatus 110 to produce the set of output signals, which drives the speaker array 120, facilitates flexibility in orientation of the first, second and third speakers 120*a*/120*b*/120*c* of the speaker array 120. Thus, considerations in terms of placement of each speaker with respect to the listener need not necessarily be as stringent, as compared with conventional techniques in which incorrect or inaccurate placement of speakers may potentially detract listener experience. Thus the system 100 can afford user friendliness in terms of implementation.

Moreover, for a compact arrangement, as desired, the first, second and third speakers 120*a*/120*b*/120*c* can be positioned such that the distance between each can be minimized. More specifically, the first speaker 120*a* can be positioned at one side of the third speaker 120*c* at as close a distance as possible and the second speaker 120*b* can be positioned at another side of the third speaker 120*c* at as close a distance as possible, for the purpose of a compact arrangement, if desired. For example, the first speaker 120*a* can be positioned such that it is just contacting one side of the third speaker 120*c* and the second speaker 120*b* can be positioned such that it is just contacting another side of the third speaker 120*c*.

Additionally, the chassis or housing 430 can be configured such that the first and second speakers 120*a*/120*b* can be tilted at an angle 440 with respect to the third speaker 120*c*. For example, the chassis or housing 430 can be configured for flexible positioning of the first and second speakers 120*a*/120*b* such that they can be flexibly tilted, at a tilt angle 440, with respect to the third speaker 120*c*.

Figure 5:
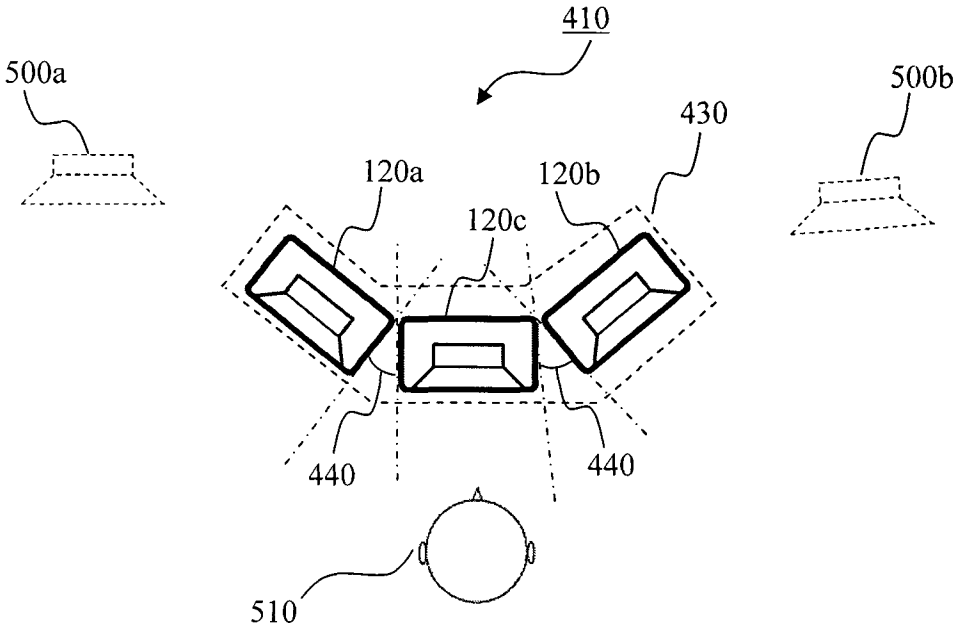
FIG. 5 shows, with reference to the exemplary orientation of the speaker array of FIG. 4, a first phantom image and a second phantom image which can be perceived by a listener.

Based on the exemplary orientation of FIG. 4, a first phantom image 500*a* and a second phantom image 500*b* can be perceived by a listener 510, as shown in FIG. 5.

Specifically, based respectively on the first and second output signals, the first and second phantom images 500*a*/500*b* can be audibly perceived by a listener via the speaker array 120 of the system 100.

More specifically, the first phantom image 500*a* can be audibly perceived by the listener to be projected from an offset position from the first speaker 120*a* of the speaker array 120 and the second phantom image 500*b* can be audibly perceived by the listener to be projected from an offset position from the second speaker 120*b* of the speaker array 120.

The offset position from the first speaker 120*a* and the offset position from the second speaker 120*b* can be determined by the second and first filters 118*d*/118*c* respectively. Thus the offset position from the first speaker 120*a* and the offset position from the second speaker 120*b* can be varied or adjusted by varying or adjusting the filter characteristics of the respective second and first filters 118*d*/118*c*.

As the first and second phantom images 500*a*/500*b* can be audibly perceived to be projected at an offset position from the first and second speakers 120*a*/120*b* respectively, the aforementioned stereo width can thus be effectively widened.

Thus, in contrast with conventional positioning of speakers where a listener needs to be strategically surrounded with speakers, it is appreciable that the manner in which the first and second input signals are processed by the processing apparatus 110 can facilitate positioning of speakers such that the speakers can face away from a listener. Therefore the first, second and third speakers 120*a*/120*b*/120*c* can be flexibly positioned, without being overly setup dependent, and still provide an enlarged "sweet spot" as compared with "sweet spot" of conventional speaker systems.

Furthermore, although the first and second phantom images 500*a*/500*b* are discussed with reference to the exemplary orientation of FIG. 4 and the exemplary orientation of FIG. 4 relates to the first exemplary configuration of the speaker array 120 as discussed with reference to FIG. 1*e*, it is appreciable that the foregoing discussion, where appropriate, pertaining to the first and second phantom images 500*a*/500*b* can analogously apply to the second exemplary configuration of the speaker array 120 as discussed with reference to FIG. 1*f*.

In the foregoing manner, various embodiments of the disclosure are described for addressing at least one of the foregoing disadvantages. Such embodiments are intended to be encompassed by the following claims, and are not to be limited to specific forms or arrangements of parts so described and it will be apparent to one skilled in the art in view of this disclosure that numerous changes and/or modification can be made, which are also intended to be encompassed by the following claims.

The invention claimed is:

1. A processing apparatus configurable for receiving and processing a set of input signals comprising a first input signal and a second input signal, the processing apparatus comprising:

an input portion configurable for receiving and processing the set of input signals in a manner so as to produce processed input signals;

an intermediate portion coupled to the input portion in a manner so as to receive the set of input signals and the processed input signals, the intermediate portion being configurable for processing the processed input signals in a manner so as to produce a compensated signal, the intermediate portion being further configurable for processing the set of input signals in a manner such that the first input signal is mixed with at least a portion of the compensated signal to produce a first mixed signal and the second input signal is mixed with at least a portion of the compensated signal to produce a second mixed signal; and an output portion coupled to the intermediate portion in a manner so as to receive the first mixed signal and the second mixed signal, the output portion being configurable to process the first and second mixed signals in a manner so as to produce a set of output signals comprising a first output signal and a second output signal, wherein the output portion is configurable to process the first and second mixed signals in a manner so as to produce a first filter processed signal and a second filter processed signal respectively, wherein the output portion is further configurable to produce the first and second output signals based on the second filter processed signal and the first filter processed signal respectively, and wherein the input portion is configurable for receiving and processing the set of input signals in a manner so as to produce processed input signals comprising a first processed input signal and a second processed input signal, the input portion comprising:

a first detector configurable to receive and process the first input signal in a manner so as to produce a first preliminary signal;

a second detector configurable to receive and process the second input signal in a manner so as to produce a second preliminary signal;

a first combiner coupled to the second detector, the first combiner being configurable to receive and process the first input signal and the second preliminary signal by combining both signals in a manner so as to produce the first processed input signal; and a second combiner coupled to the first detector, the second combiner being configurable to receive and process the second input signal and the first preliminary signal by combining both signals in a manner so as to produce the second processed input signal.

2. The processing apparatus as in claim 1, wherein each of the first and second detectors is a root mean square (RMS) detector, and wherein the first and second detectors are capable of determining the RMS characteristic of the first input signal and the RMS characteristic of the second input signal respectively.

3. The processing apparatus as in claim 2, the first and second preliminary signals being indicative of the RMS characteristic of the first input signal and the RMS characteristic of the second input signal respectively.

4. The processing apparatus as in claim 1 wherein each of the first and second combiners is a multiplier.

5. The processing apparatus as in claim 4, wherein the first combiner is configurable to process the first input signal and the second preliminary signal in a manner such that both signals are combined via multiplication so that the first processed input signal corresponds to the product of the first input signal and the second preliminary signal, and wherein the second combiner is configurable to process the second input signal and the first preliminary signal in a manner such that both signals are combined via multiplication so that the second processed input signal corresponds to the product of the second input signal and the first preliminary signal.

6. The processing apparatus as in claim 1 wherein the processed input signals comprise a first processed input signal and a second processed input signal, and wherein the intermediate portion comprises:

a first intermediate mixer coupled to the input portion in a manner so as to receive the first input signal, the first intermediate mixer being configurable for producing a first mixed signal;

a second intermediate mixer coupled to the input portion in a manner so as to receive the second input signal, the second intermediate mixer being configurable for producing a second mixed signal;

a third intermediate mixer coupled to the input portion in a manner so as to receive the processed input signals, the third intermediate mixer being configurable for processing the first and second processed input signals in a manner such that the first processed input signal is mixed with the second processed input signal so as to produce a third mixed signal; and a compensator coupled to at least one of the first intermediate mixer, the second intermediate mixer and the third intermediate mixer, the compensator being configurable for receiving and processing the third mixed signal in a manner so as to produce the compensated signal, the compensator being further configurable to communicate at least a portion of the compensated signal to each of the first and second intermediate mixers, wherein the first mixer is configurable for processing the first input signal in a manner such that the first input signal is mixed with at least a portion of the compensated signal so as to produce the first mixed signal, and wherein the second mixer is configurable for processing the second input signal in a manner such that the second input signal is mixed with at least a portion of the compensated signal so as to produce the second mixed signal.

7. The processing apparatus as in claim 6 wherein the first intermediate mixer is configurable for processing the first input signal and at least a portion of the compensated signal such that the first input signal is out-of-phase with respect to the at least a portion of the compensated signal.

8. The processing apparatus as in claim 7 wherein the first intermediate mixer is a subtractor and the first mixed signal corresponds to the subtraction of at least a portion of the compensated signal from the first input signal.

9. The processing apparatus as in claim 6 wherein the second intermediate mixer is configurable for processing the second input signal and at least a portion of the compensated signal such that the second input signal is out-of-phase with respect to the at least a portion of the compensated signal.

10. The processing apparatus as in claim 9 wherein the second intermediate mixer is a subtractor and the second mixed signal corresponds to the subtraction of at least a portion of the compensated signal from the second input signal.

11. The processing apparatus as in claim 6 wherein the third intermediate mixer is configurable for processing the first and second processed input signals such that the first processed input signal is in-phase with respect to the second processed input signal.

12. The processing apparatus as in claim 11 wherein the third intermediate mixer is an adder and the third mixed signal corresponds to the summation of the first and second processed input signals.

13. The processing apparatus as in claim 6, wherein the compensator is configurable to process the third mixed signal in a manner so as to compress the third mixed signal so as to produce the compensated signal, and wherein the set of output signals further includes a third output signal which is based on at least a portion of the compensated signal.

14. The processing apparatus as in claim 13 wherein the compensator is a compressor associated with a compression ratio of 2:1 and the compensated signal corresponds to the compression of the third mixed signal.

15. The processing apparatus as in claim 1, the output portion comprising:

a first frequency processing portion coupled to the first intermediate mixer;

a second frequency processing portion coupled to the second intermediate mixer;

a first filter coupled to the first frequency processing portion;

a second filter coupled to the second frequency processing portion;

a first output mixer coupled to the first frequency processing portion and the second filter; and a second output mixer coupled to the second frequency processing portion and the first filter.

16. The processing apparatus as in claim 15, wherein the first frequency processing portion is configurable for receiving and processing the first mixed signal in a manner so as to produce a first frequency processed signal, wherein the second frequency processing portion is configurable for receiving and processing the second mixed signal in a manner so as to produce a second frequency processed signal, wherein the first filter is configurable for receiving and processing the first frequency processed signal in a manner so as to produce the first filter processed signal, wherein the second filter is configurable for receiving and processing the second frequency processed signal in a manner so as to produce the second filter processed signal, wherein the first output mixer is configurable for receiving and processing the first frequency processed signal and the second filter processed signal in a manner so as to mix both signals, and wherein the second output mixer is configurable for receiving and processing the second frequency processed signal and the first filter processed signal in a manner so as to mix both signals.

17. The processing apparatus as in claim 16, wherein the first output signal is based on the mixed first frequency processed and second filter processed signals, and wherein the second output signal is based on the mixed second frequency processed and first filter processed signals.

18. A processing apparatus configurable for receiving and processing a set of input signals from an input module, the set of input signals comprising a first input signal and a second input signal, the processing apparatus configurable for processing the set of input signals in a manner so as to produce a set of output signals communicable to an output module, the processing apparatus comprising:

an input portion configurable for receiving the set of input signals from the input module and processing the set of input signals in a manner so as to produce processed input signals comprising a first processed input signal and a second processed input signal; and an intermediate portion coupled to the input portion in a manner so as to receive the set of input signals and the processed input signals, the intermediate portion being configurable for processing the processed input signals in a manner so as to produce a compensated signal, the intermediate portion being further configurable for processing the set of input signals in a manner such that the first input signal is mixed with at least a portion of the compensated signal to produce a first mixed signal and the second input signal is mixed with at least a portion of the compensated signal to produce a second mixed signal, the intermediate portion comprising:

a first mixer coupled to the input portion in a manner so as to receive the first input signal, the first mixer being configurable for producing the first mixed signal;

a second mixer coupled to the input portion in a manner so as to receive the second input signal, the second mixer being configurable for producing the second mixed signal;

a third mixer coupled to the input portion in a manner so as to receive the processed input signals, the third mixer being configurable for processing the first and second processed input signals in a manner such that the first processed input signal is mixed with the second processed input signal so as to produce a third mixed signal; and a compensator coupled to at least one of the first mixer, the second mixer and the third mixer, the compensator being configurable for receiving and processing the third mixed signal in a manner so as to produce the compensated signal, the compensator being further configurable to communicate at least a portion of the compensated signal to each of the first and second mixers; and an output portion coupled to the intermediate portion in a manner so as to receive the first mixed signal and the second mixed signal, the output portion being configurable to process the first and second mixed signals in a manner so as to produce the set of output signals, the set of output signals comprising a first output signal and a second output signal, wherein the output portion is configurable to process the first and second mixed signals in a manner so as to produce a first filter processed signal and a second filter processed signal respectively, and wherein the output portion is further configurable to produce the first and second output signals based on the second filter processed signal and the first filter processed signal respectively.

* * * * *